US005956943A

United States Patent [19]

Carnevale et al.

[11] Patent Number: 5,956,943

[45] Date of Patent: Sep. 28, 1999

[54] METHOD OF DIAGNOSING THE EFFICIENCY OF AN EXHAUST GAS STOICHIOMETRIC COMPOSITION SENSOR PLACED DOWNSTREAM OF A CATALYTIC CONVERTER

[75] Inventors: Claudio Carnevale, Nole Canavese; Paola Bianconi, Turin; Stefano Sgatti, Imola, all of Italy

[73] Assignee: Magneti Marelli S.p.A., Italy

[21] Appl. No.: 08/816,137

[22] Filed: Mar. 12, 1997

[30] Foreign Application Priority Data

Mar. 12, 1996 [IT] Italy ..... TO96A0181

[51] Int. Cl.[6] ..... F01N 3/00

[52] U.S. Cl. ..... 60/274; 60/276; 60/285; 123/688

[58] Field of Search ..... 60/274, 276, 285, 60/277; 123/688

[56] References Cited

U.S. PATENT DOCUMENTS

| | | | |
|---|---|---|---|
| 3,948,228 | 4/1976 | Luchaco | 123/32 EA |
| 4,177,787 | 12/1979 | Hattori et al. | 60/277 |
| 4,844,038 | 7/1989 | Yamato et al. | 123/479 |
| 5,154,054 | 10/1992 | Nakane et al. | 60/276 |
| 5,182,907 | 2/1993 | Kuroda et al. | 60/276 |
| 5,212,947 | 5/1993 | Fujimoto et al. | 60/276 |
| 5,331,808 | 7/1994 | Koike | 60/276 |
| 5,485,382 | 1/1996 | Seki et al. | 60/274 |
| 5,533,332 | 7/1996 | Uchikawa | 123/688 |
| 5,568,725 | 10/1996 | Uchikawa | 60/274 |

FOREIGN PATENT DOCUMENTS

| | | |
|---|---|---|
| 0402953 | 12/1990 | European Pat. Off. . |
| 0616119 | 3/1993 | European Pat. Off. . |
| 0616121 | 9/1994 | European Pat. Off. . |
| 0657637 | 6/1995 | European Pat. Off. . |
| 4117986 | 5/1991 | Germany . |

OTHER PUBLICATIONS

EPO "Communication", Partial Search Report Jul. 3, 1997 4 pages.

EPO "Communication" Search Report Nov. 12, 1997 5 pages.

*Primary Examiner*—Thomas E. Denion

*Attorney, Agent, or Firm*—Hall, Priddy & Myers

[57] ABSTRACT

The method of diagnosis determines the state of deterioration of an exhaust gas stoichiometric composition sensor placed downstream of a catalytic converter. The catalytic converter is mounted on an exhaust manifold of an internal combustion engine supplied with an air/fuel mixture, while the sensor generates an output signal correlated with the stoichiometric composition of the mixture. The method comprises the phases of registering a temperature signal correlated with the temperature of the engine; determining the operating range of the engine; determining the stoichiometric composition of the air/fuel mixture; and effecting a hot diagnosis should the temperature signal be greater than a preset reference value, the engine be in the idle operating range and the sensor register a weak stoichiometric composition of the mixture. The hot diagnosis comprises the phases of generating control signals for the engine and of gauging the output signal from the sensor.

26 Claims, 5 Drawing Sheets

METHOD OF DIAGNOSING THE EFFICIENCY OF AN EXHAUST GAS STOICHIOMETRIC COMPOSITION SENSOR PLACED DOWNSTREAM OF A CATALYTIC CONVERTER

BACKGROUND OF THE INVENTION

The present invention relates to a method of diagnosing the efficiency of an exhaust gas stoichiometric composition sensor placed downstream of a catalytic converter.

As is known, two exhaust gas stoichiometric composition sensors (lambda probes), arranged upstream and downstream of the catalytic converter, respectively, are present on catalyzed vehicles equipped for conducting on-board diagnosis operations.

Each of the sensors is able to generate an output signal which, after suitable processing, exhibits two levels dependent on the stoichiometric composition of the exhaust gases and, consequently, on the stoichiometric composition of the air/fuel mixture supplied to the engine.

In particular, if the air/fuel mixture has more fuel than required by the stoichiometric ratio (rich mixture) the signal generated by the sensor assumes a high value (typically 800–900 mV), whereas if the air/fuel mixture has less fuel than required by the stoichiometric ratio (weak mixture) the signal generated by the sensor assumes a low value (typically 100–200 mV).

The regulations in force for vehicle emissions stipulate that a sensor should be declared faulty when its deterioration is such that it does not allow correct operation of the supply unit, so that the emissions exceed preset limits, or else is such that the sensor delivers unreliable values and cannot therefore be used to perform the required diagnoses on-board the vehicle.

Such a deterioration is manifested via a variation in the voltage levels of the output signal generated by the sensor and/or via an increase in the switching time of the sensor, defined as the delay between a variation in the stoichiometric ratio of the mixture and the corresponding change in the level of the output signal generated by the sensor.

Numerous methods of diagnosis have been developed in order to register such a deterioration. However, such methods are capable of diagnosing only malfunctions of the sensor placed upstream of the catalytic converter, because the gauging of malfunctions of the sensor placed downstream of the catalytic converter is strongly influenced by the state of deterioration of other components of the vehicle, in particular by the deterioration of the catalytic converter, which such methods are incapable of distinguishing.

SUMMARY OF THE INVENTION

The object of the present invention is to provide a method of diagnosis capable of gauging the state of deterioration of an exhaust gas stoichiometric composition sensor placed downstream of a catalytic converter.

According to the present invention a method is provided for diagnosing the efficiency of an exhaust gas stoichiometric composition sensor placed downstream of a catalytic converter mounted on an exhaust manifold of an internal combustion engine supplied with an air/fuel mixture, the said sensor generating an output signal correlated with the composition of the said mixture, characterized in that it comprises the phases of:

registering a temperature signal correlated with the temperature of the said engine;

determining the operating range of the said engine;

determining the composition of the said air/ fuel mixture; and effecting a hot diagnosis should the said temperature signal be greater than a preset reference value, the said engine be in the idle operating range and the said sensor register a weak composition of the said mixture; the said hot diagnosis comprising the phases of generating control signals for the said engine and of gauging the said output signal from the said sensor.

BRIEF DESCRIPTION OF THE DRAWINGS

For a fuller understanding of the present invention, a preferred embodiment will now be described, purely by way of non-limiting example and with reference to the appended drawings in which.

DETAILED DESCRIPTION OF THE INVENTION

Figure 1:
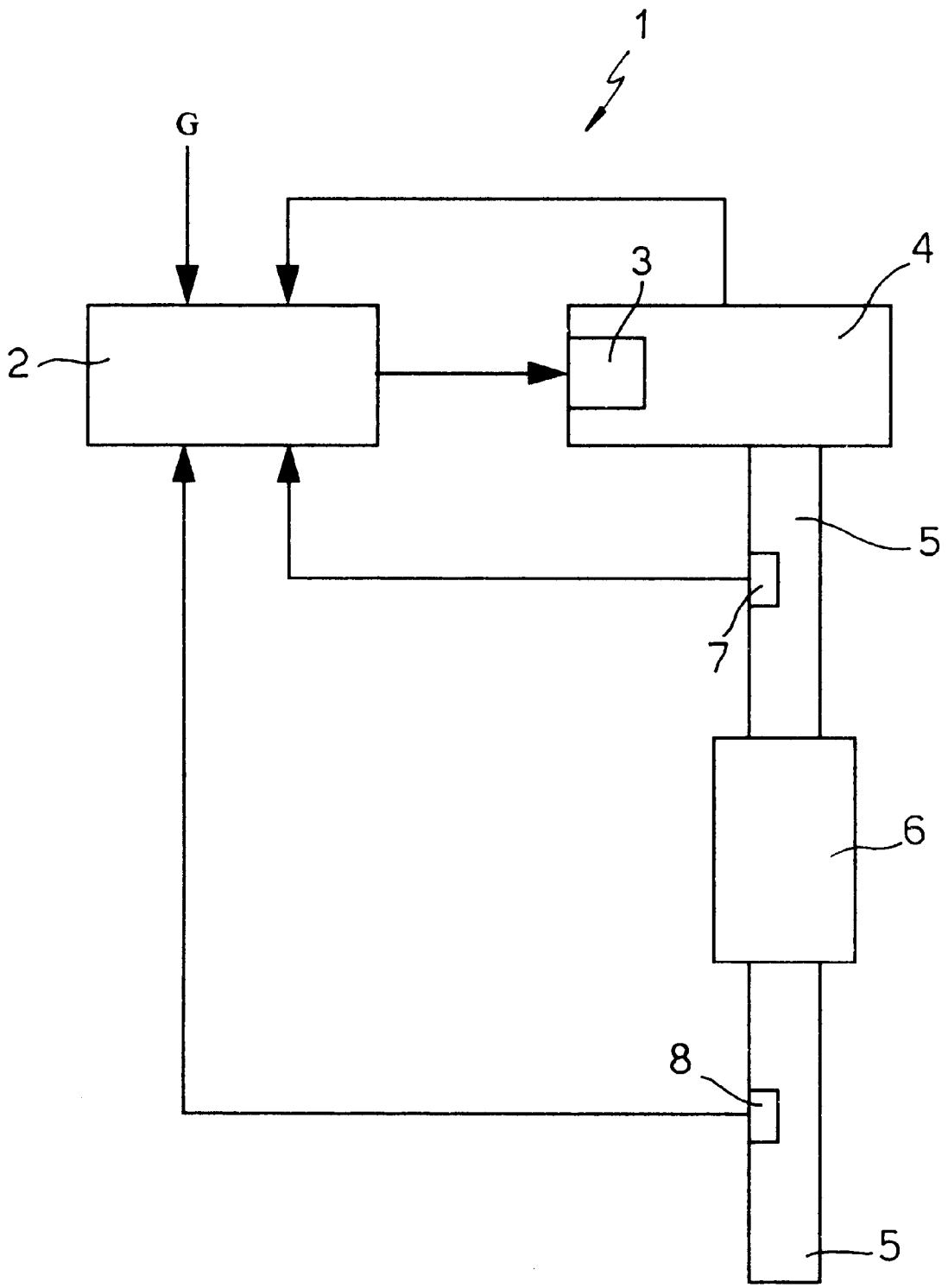
FIG. 1 illustrates, diagrammatically, a system for diagnosing a lambda probe.

Indicated in its entirety by 1, FIG. 1 shows a diagnosis system comprising an electronic facility 2 able to control, in use, an injection unit 3 (represented diagrammatically) of an internal combustion engine 4, which has an exhaust manifold 5 along which is arranged a catalytic converter 6 (of known type).

The diagnosis system 1 furthermore comprises two exhaust gas stoichiometric composition sensors 7, 8 (indicated subsequently by the term lambda probe) arranged on the exhaust manifold 5, upstream of the catalytic converter 6 (i.e. between the engine 4 and the catalytic converter 6) and, respectively, downstream of the catalytic converter 6.

The lambda probes 7, 8 are connected to the input of the electronic facility 2, which also receives a plurality of engine magnitudes measured on the engine 4 and control magnitudes, described in greater detail subsequently and indicated overall as G.

The electronic facility 2 also implements diagnosis operations for registering a possible malfunction of the probe 8 placed downstream of the catalytic converter, which operations will be illustrated in greater detail subsequently with reference to FIG. 2.

Figure 2:
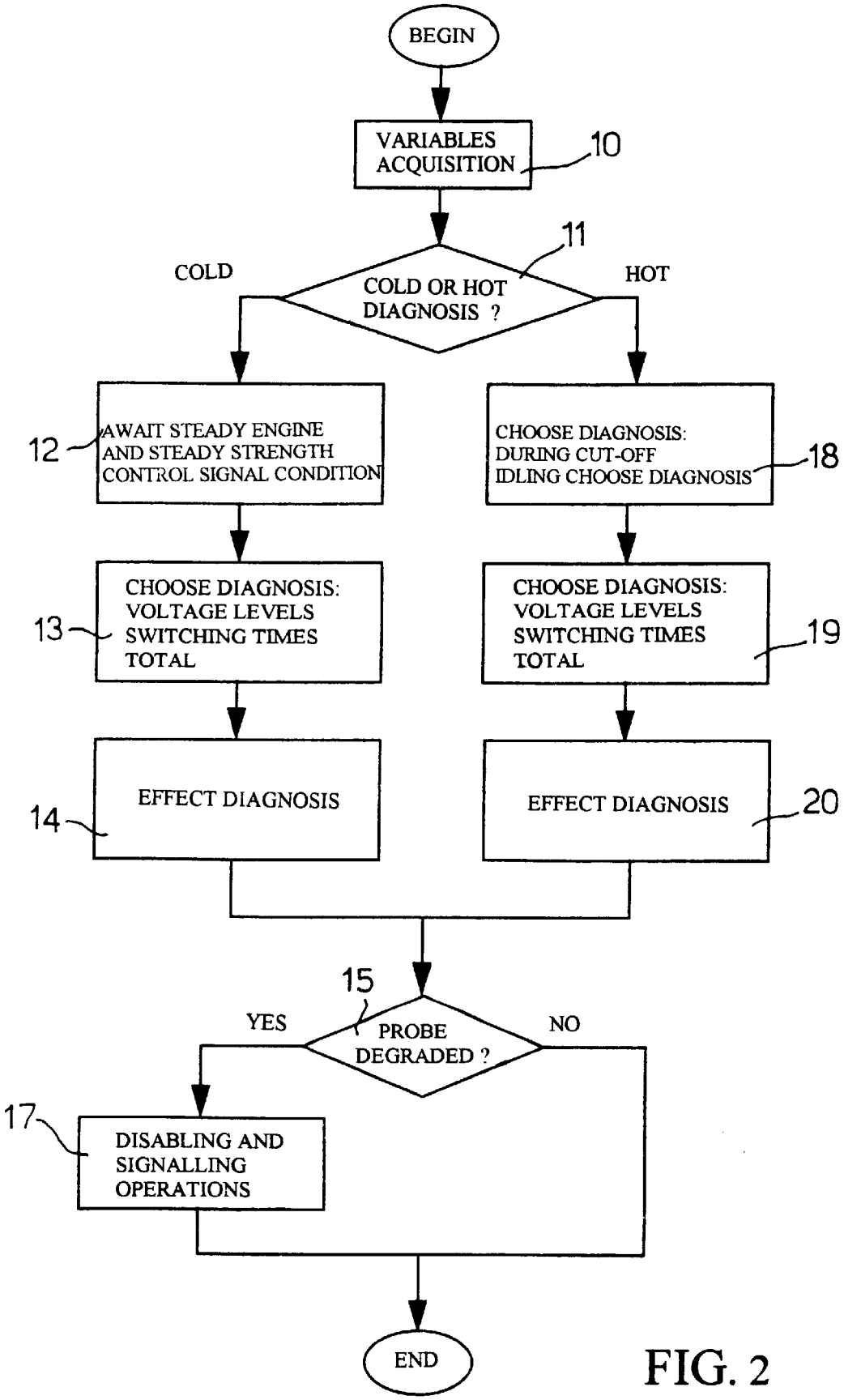
FIG. 2 illustrates a flow diagram relating to the method which is the subject of the invention.

According to what is shown in the flow diagram of FIG. 2, a plurality of engine magnitudes measured on the engine 4 and control magnitudes G (block 10) are acquired initially.

In particular, the following are acquired: the temperature T of the engine cooling fluid; the number of revolutions N of the engine 4; the derivative of the position ΔP of the butterfly valve (not illustrated); the derivative of the quantity of air ΔQa present in the intake manifold (not illustrated); a code M relating to the current operating condition of the engine 4, i.e. whether the engine 4 is in the cut-off (interruption of fuel supply to the engine), idling, steady, accelerating or decelerating condition, etc.; a signal K02 for controlling the strength of the mixture supplied to the engine 4; a binary variable FCL (FLAG CLOSED LOOP) whose state, 1 or 0, indicates whether or not the strength control is closed-loop; a time $t_{cf}$ of residence of the engine 4 in a possible cut-off state; and the voltage V generated by the lambda probe 8 placed downstream of the catalytic converter 6.

One of two ways of diagnosing the lambda probe 8 placed downstream of the catalytic converter 6 (block 11) is selected on the basis of the value of the temperature T of the cooling fluid of the engine 4. In particular, if the temperature T is below a preset reference value $T_0$, then a series of operations indicated by the term "cold diagnosis" is effected, otherwise another series of operations indicated by the term "hot diagnosis" is effected.

With each use of the vehicle (not illustrated) the cold diagnosis may be effected once only, i.e. immediately after turning on the engine 4, whereas the hot diagnosis may be effected an unlimited number of times, during the operation of the engine 4.

Both types of diagnosis are based on altering the strength of the mixture supplied to the engine 4 so as to cause switchings of the lambda probe 8. The relevant signal generated by the probe 8 is then used to gauge a possible state of deterioration of the probe 8.

The two, cold and hot, types of diagnosis are mutually independent and make it possible to diagnose, respectively, probes exhibiting moderate deterioration and probes exhibiting strong deterioration.

Indeed, the cold diagnosis is effected at low temperatures (which may for example be those present for morning starts of the vehicle) and at these temperatures the catalytic converter 6 is inoperative and hence the gauging of the state of deterioration of the probe 8 is independent of the state of deterioration of the catalytic converter 6.

In this situation, in fact, the switching time of the probe 8, defined as the delay between a variation in the stoichiometric ratio of the mixture and the corresponding change in the level of the output signal generated by the sensor, is correlated with the switching delay of the probe 8 and with the propagation delay of the exhaust gases from the probe 7, placed upstream of the catalytic converter 6, to the probe 8, placed downstream thereof and is independent of the filtration time constant of the catalytic converter 6.

On the other hand, the hot diagnosis is effected at higher temperatures at which the catalytic converter 6 is operative and strongly influences the gauging.

In this situation the switching time of the probe 8 is correlated, not only with the switching delay of the probe 8 and the exhaust gas propagation delay, but also with the filtration time constant of the catalytic converter 6 and hence only when the delay introduced by the probe 8 is much greater than the delay introduced by the catalytic converter 6 is the diagnosis reliable and uninfluenced by the deterioration in the catalytic converter 6.

Hence, probes exhibiting strong deterioration, i.e. probes having a switching delay of the order of at least 2–3 seconds, can be diagnosed with the hot diagnosis.

If the cold diagnosis is selected in block 11, the occurrence of the steady engine 4 condition and of the steady strength control condition is firstly awaited (block 12). In particular, the first condition occurs when the derivative of the position ΔP of the butterfly valve vanishes, whereas the second condition occurs when the peak-to-peak amplitude of the signal K02 for controlling the strength of the mixture is less than a preset threshold.

When the engine 4 is in the steady range, a choice (block 13) is made regarding the accuracy of the gauging desired, i.e. whether it is desired to perform:

a) partial processing based on gauging the variation in the voltage levels of the output signal V from the probe 8;

b) partial processing based on gauging the increase in the switching time of the probe 8; or c) complete processing based on gauging both of the above characteristics.

Once this choice has been made, the operations relating to the type of processing desired are then effected (block 14), these being described in detail subsequently with reference to FIGS. 3–7.

These operations generate signals which indicate the deterioration of the probe 8 and which are gauged for distinguishing the condition of deterioration (block 15).

If the probe does not exhibit deterioration, the electronic facility 2 terminates the diagnosis, otherwise it effects disabling and signalling operations (block 17). These operations disable the diagnosis of the catalytic converter 6, disable the strength control based on the deteriorated probe 8, turn on a fault signalling lamp, store a code corresponding to the type of fault and disable of any subsequent diagnosis of the deteriorated probe 8 until the fault code is cancelled.

If the hot diagnosis is selected by block 11, the occurrence of one of the following engine conditions is firstly awaited (block 18):

1) cut-off condition of duration $t_{cf}$ greater than a preset threshold and probe 8 registering a rich composition of the mixture before the occurrence of the cut-off condition;

2) idling engine 4 condition subsequent to a cut-off condition and probe 8 registering a weak composition of the mixture.

If the first condition is present, for example following release of the accelerator pedal (not illustrated) after heavy acceleration, a first series of operations indicated by the term "processing during cut-off" is effected, whereas if the second condition is present a second series of operations indicated by the term "idling processing" is effected.

For reasons which will be clear later, both processing operations must be performed, so that if a processing during cut-off is effected first, it is then necessary to effect an idling processing, and vice versa.

For both types of processing, a choice is then again made between partial processing on the voltage levels, partial processing on the switching times of the probe 8 or complete processing (block 19).

Once this choice is made, the operations relating to the type of processing desired are executed (block 20), these being described in detail later with reference to FIGS. 8–11 and 5–7. These operations generate signals which indicate the deterioration of the probe 8 and which are gauged for distinguishing the condition of deterioration (block 15).

If the probe does not exhibit deterioration, the electronic facility 2 terminates the diagnosis, otherwise the disabling and signalling operations described above are effected (block 17).

The various operations effected during cold diagnosis will be described in detail later, depending on the type of processing chosen.

If partial processing on the voltage levels of the output signal V from the probe 8 is chosen, the operations shown and described hereinafter with reference to FIG. 3 will be effected.

This processing initially modifies the mixture strength control signal K02, which defines a weakening signal for the mixture supplied to the engine 4. This gives rise to a reduction in the quantity of fuel in the mixture, causing a rich/lean transition of the mixture (block 30) and a variation of the voltage V generated by the probe 8 from the high level to the low level. As soon as the high/low transition has terminated, the value $V_{min}$ assumed by the voltage V is acquired (block 31).

The mixture strength control signal K02 is then modified again, thereby defining an enrichment signal for the mixture supplied to the engine 4.

This gives rise to an increase in the quantity of fuel in the mixture, causing a lean/rich transition of the mixture (block 32) and a variation of the voltage V from the low level to the high level. As soon as the low/high transition has terminated, the value $V_{max}$ assumed by the voltage V is acquired (block 33).

Processing on the voltage levels then proceeds (FIG. 5) with the calculation of an intermediate value $V_{int}$ (block 34) equal to:

$$V_{int} = \frac{V_{\max} - V_{\min}}{2}$$

Subsequently, $V_{min}$, $V_{max}$ and $V_{int}$ are compared with respective, previously set, threshold values (block 35).

In particular, a check is made as to whether:

$$V_{min} < V_{th1}$$

$$V_{max} > V_{th2}$$

$$V_{th3} < V_{int} < V_{th4}$$

in which $V_{th1}$, $V_{th2}$, $V_{th3}$ and $V_{th4}$ are the aforesaid preset threshold values.

If all the aforesaid comparisons give a positive outcome, a first deterioration signal $S_{D1}$ is generated having a first level (for example high), and indicating levels $V_{min}$ and $V_{max}$ which are correct or subject to negligible variations (block 36), vice versa, if any one of these comparisons gives a negative outcome, the deterioration signal $S_{D1}$ assumes a second level (in the case considered, low) indicating the fact that the voltage levels of the probe 8 have undergone excessive variations and the probe 8 has deteriorated (block 37).

This first deterioration signal $S_{D1}$ is then used by block 15 of FIG. 2, which gauges its level for distinguishing the condition of deterioration.

A deterioration in the probe 8 is therefore diagnosed if at least one of the two levels $V_{min}$ and $V_{max}$ exceeds the respective threshold or if both levels undergo modifications such as to make the intermediate value $V_{int}$ vary excessively.

Calculating $V_{int}$ and checking that it belongs to an accepted interval of variation is of considerable importance insofar as one of the possible deteriorations is one in which unsymmetrical variations in the two levels $V_{min}$ and $V_{max}$ are present, i.e. there is a variation of one of the two voltage levels, for example $V_{min}$, tending to move the level towards the respective threshold, and a variation of the other voltage level, in the example considered $V_{max}$, tending to move the level away from the respective threshold.

In this situation, checks on the voltage levels and not on the intermediate value would not be sufficient to diagnose the deterioration.

If in block 13 of FIG. 2, partial processing on the switching times of the probe 8 is chosen, the operations now described with reference to FIG. 4 will be effected.

The partial processing effected on the switching times also modifies the mixture strength control signal K02, which defines a weakening signal for the mixture and gives rise to a rich/lean transition of the mixture (block 40), with consequent transition of the voltage V from the high level to the low level.

The time integral of this voltage V is calculated (block 41), obtaining a value $I_1$ correlated with the switching delay of the probe 8; more precisely $I_1$ is calculated using the following formula:

$$I_1 = \int_{t_0}^{t_s} (V - V_{ref})\, dt$$

in which $V_{ref}$ is a preset reference value, $t_0$ is the instant in time at which the rich/lean transition of the mixture delivered to the engine 4 occurs and $t_s$ is the instant in time at which the probe 8 switches, i.e. when the voltage of the probe 8, during the transition from the high level to the low level, crosses a preset threshold value.

The mixture strength control signal K02 is then modified again, thereby defining an enrichment signal for the mixture and giving rise to a lean/rich transition of the mixture (block 42), with consequent transition of the voltage V from the low level to the high level.

The time integral of this voltage V is calculated (block 43), obtaining a value $I_2$ correlated with the switching delay of the probe 8; more precisely $I_2$ is calculated using the following formula:

$$I_2 = \int_{t_0}^{t_s} (V - V_{ref})\, dt$$

in which $V_{ref}$, $t_0$ and $t_s$ have the meaning described above.

The processing on the switching times then proceeds (FIGS. 6 and 7) with the calculation of a moving average of $I_1$ and, respectively, $I_2$ (blocks 44 of FIG. 6 and 45 of FIG. 7), thereby generating two numerical values indicated by $I_{1m}$ and, respectively, $I_{2m}$. This moving average is effected using values of $I_1$ and $I_2$ calculated during previous processing operations.

Each average value $I_{1m}$ and $I_{2m}$ is then compared with respective threshold values $I_{th1}$ and $I_{th2}$ previously stored in memory (blocks 46 of FIG. 6 and 47 of FIG. 7); in particular, a check is made as to whether $I_{1m}$ and $I_{2m}$ are less than $I_{th1}$ and, respectively, $I_{th2}$.

Figure 6:
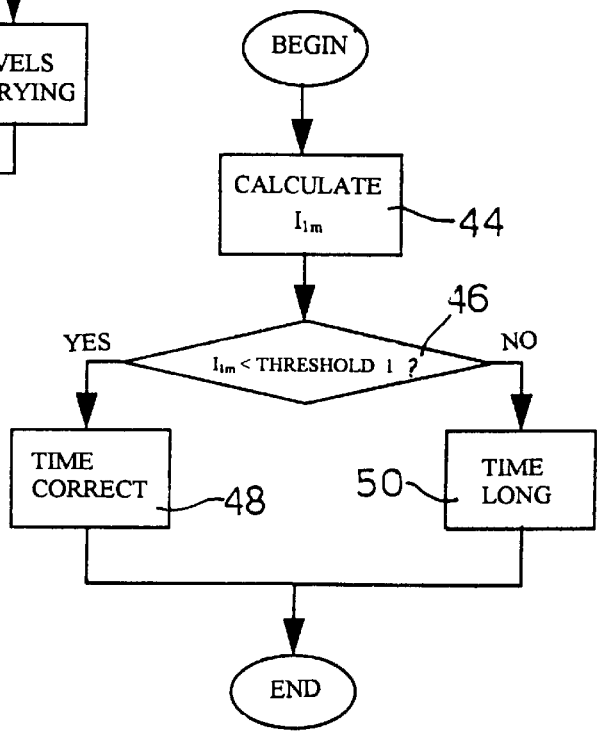
Figure 7:
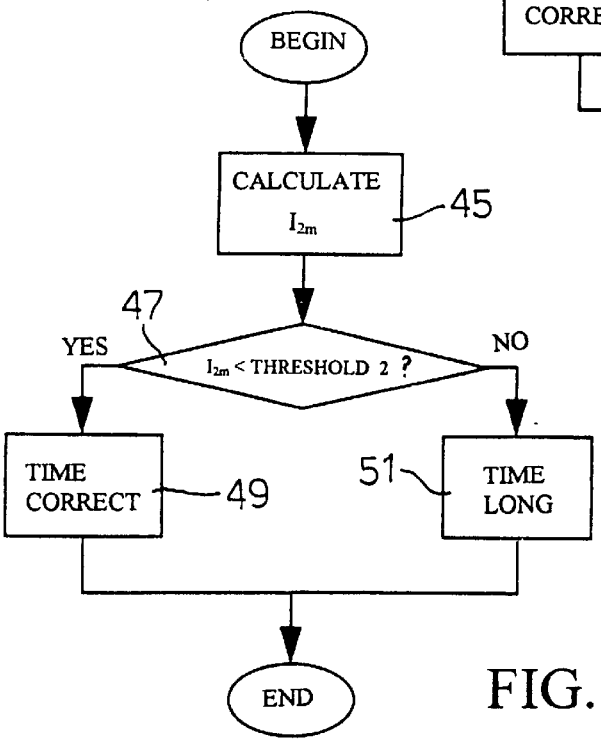

A positive outcome of each of these comparisons signifies that the switching times are correct or have undergone negligible variations (blocks 48 of FIG. 6 and 49 of FIG. 7), vice versa, a negative outcome of at least one of these comparisons signifies that these times have undergone excessive variations and that the probe has deteriorated (blocks 50 of FIG. 6 and 51 of FIG. 7).

Consequently, a second deterioration signal $S_{D2}$ is generated, assuming a first level (for example high) if the above comparisons have had different outcomes and assuming a second level if the outcomes are the same.

This second deterioration signal $S_{D2}$ is then used by block 15 of FIG. 2, which gauges its level for distinguishing the condition of deterioration.

This type of check is due to the fact that, as described above in respect of processing on voltage levels, one of the possible and more troublesome deteriorations is that in which there are unsymmetrical variations of the two switching times, whereas symmetrical variations of the two switching times are less harmful.

If in block 13 of FIG. 2, total processing is chosen either on the voltage levels or on the switching times of the probe 8, the two partial processing operations described above, and which therefore will not be described in further detail, are effected simultaneously.

In this case, block 15 of FIG. 2 will activate the operations indicated in block 17 if both of the two processing operations signal a condition of deterioration.

The operations effected during a hot diagnosis will be described in detail below.

As already described earlier, when a cut-off condition of duration greater than a threshold is present, with probe 8 registering a rich composition of the mixture before the cut-off condition, a processing during cut-off is effected; exit from the cut-off condition and the occurrence of an idling engine condition, with probe 8 registering a weak mixture composition, are then awaited and, lastly, an idling processing is effected.

Vice versa, if a cut-off condition of duration greater than a threshold is not present, with probe 8 registering a rich composition of the mixture before the cut-off condition, an idling processing is effected; subsequently, then, the occurrence of the conditions required to effect a diagnosis during cut-off in awaited and this diagnosis is effected.

The need to follow the processing during cut-off with an idling processing is due to the fact that the partial processing operations on voltage levels and on switching times during cut-off give rise (FIGS. 8 and 9), in a manner analogous to that described with reference to FIGS. 3 and 4 for cold diagnosis, to a rich/lean transition of the mixture (blocks 60 of FIG. 8 and 61 of FIG. 9), and provide for the calculation of $V_{min}$ (block 62) and, respectively, of $I_1$ (block 63).

Figure 5:
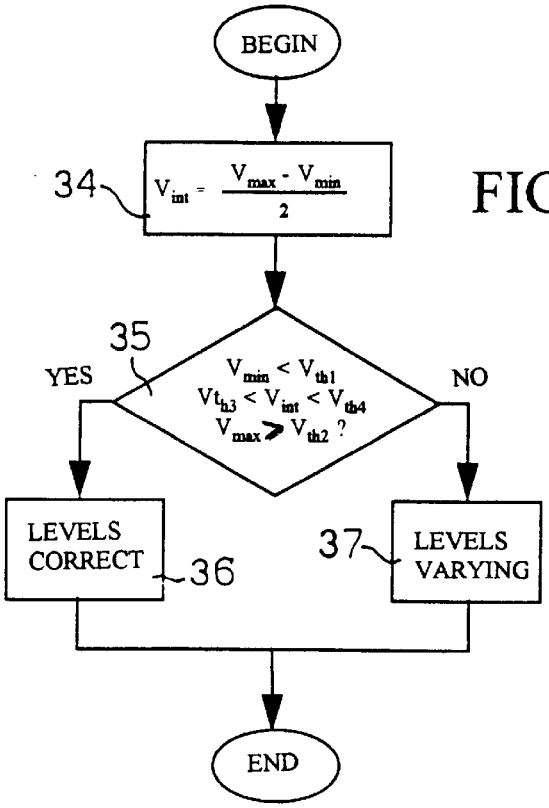

However, in order to perform the checks illustrated in FIGS. 5, 6, 7 it is essential also to have values $V_{max}$ and $I_2$, and hence it is essential to effect the respective partial processing operations performed during an idling processing. An analogous argument holds in the case in which the idling processing is performed first.

Unlike what takes place in cold diagnosis, the rich/lean transition is not obtained by modifying the mixture strength control signal K02, but is obtained spontaneously, since during cut-off there is an interruption to the engine fuel supply ordered by the engine control facility and air alone is injected into the cylinder. Consequently, after a cut-off of duration greater than a preset threshold, the probe 8 registers a weak mixture composition, given the elevated quantity of oxygen present in the catalytic converter 6.

Figure 3:
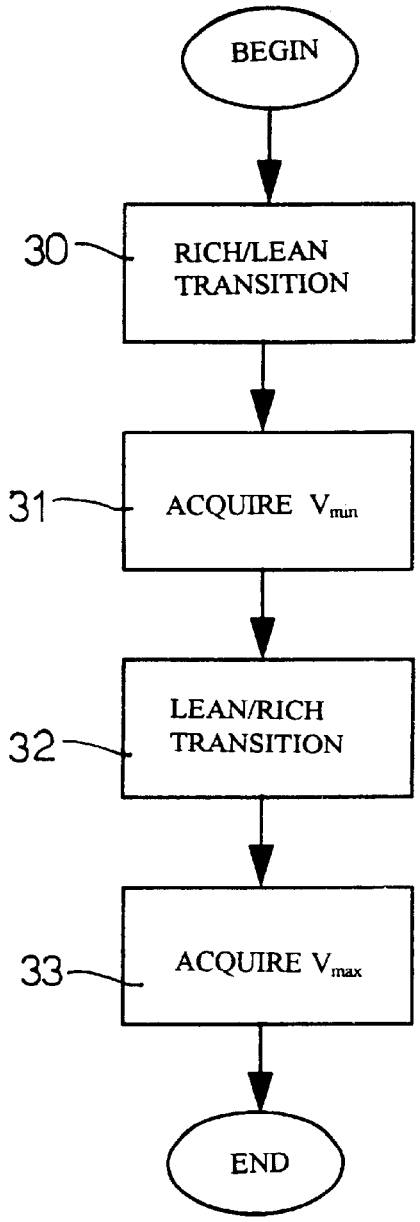
FIGS. 3 to 11 are flow diagrams relating to blocks from FIG. 2.
Figure 4:
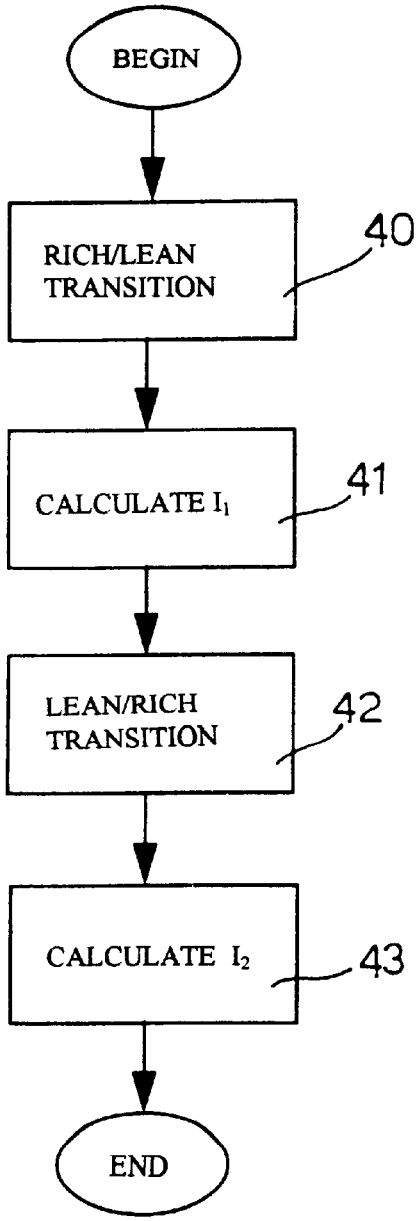

During the idling processing, effected after exit from the cut-off condition and with the probe registering a weak mixture composition, the mixture strength control signal K02 is then modified again (FIGS. 10 and 11), defining a mixture enrichment signal and giving rise to a lean/rich transition of the mixture (blocks 70 of FIG. 10 and 71 of FIG. 11) and the calculation of $V_{max}$ (block 72) and, respectively, the calculation of $I_2$ (block 73) are effected, in analogous manner to that illustrated in FIGS. 3 and 4.

After this, checking operations identical to those illustrated with reference to FIGS. 5, 6 and 7, and hence not described in further detail, are effected.

Figure 8:
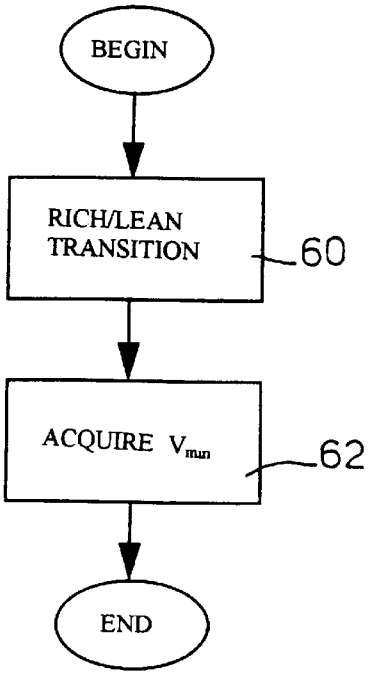
Figure 9:
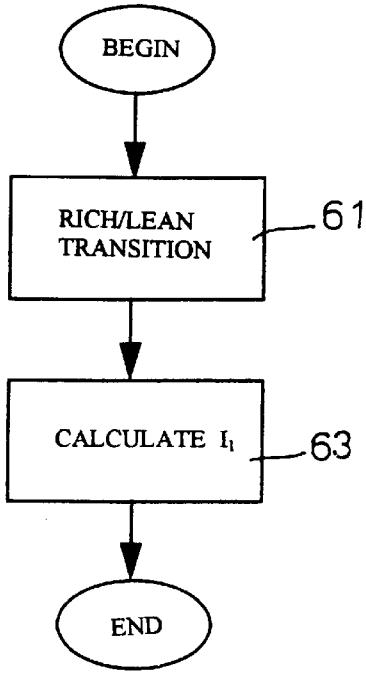
Figure 10:
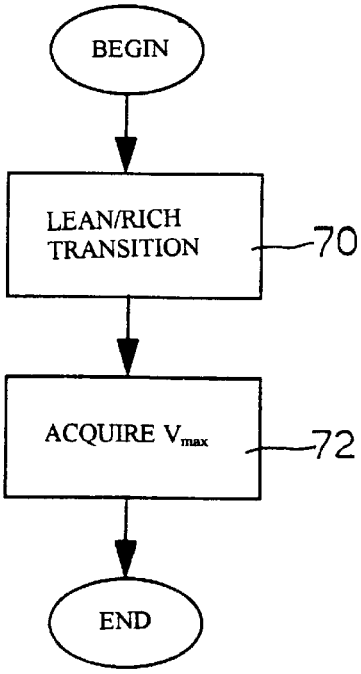
Figure 11:
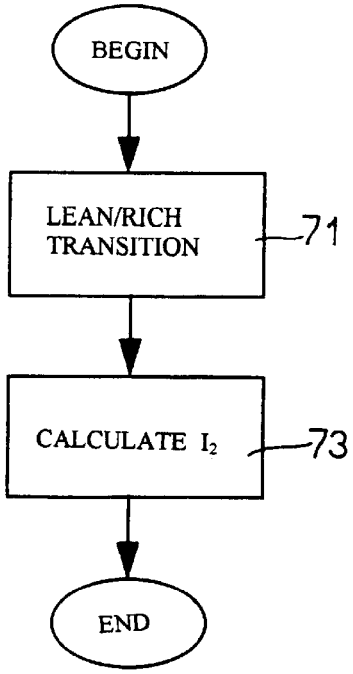

Analogously, after the idling processing, as illustrated in FIGS. 10 and 11, the processing during cut-off, as illustrated in FIGS. 8 and 9, and hence not described again, is effected, the checks described with reference to FIGS. 5–7 being effected on termination.

In short, the total processing effected both on the voltage levels and on the switching times can be effected in any sequence indicated above, and simultaneously effects the two partial processing operations, on the voltage levels and on the switching times, described above.

The advantages of the present method are as follows. Firstly it enables moderately deteriorated probes 8 to be diagnosed by cold diagnosis.

Furthermore, the present method enables a complete diagnosis of the probe 8 to be performed, also effecting a hot diagnosis.

In short, the present method is simple, easy to implement and does not require modifications to the injection unit or the special availability of dedicated devices, since the operations required can be effected directly by the facility which controls the electronic injection.

Finally, it is clear that modifications and variations may be made to the method described and illustrated here without thereby departing from the scope of the present invention.

We claim:

1. A method of diagnosing the efficiency of an exhaust gas stoichiometric composition sensor placed downstream of a catalytic converter mounted on an exhaust manifold of an internal combustion engine supplied with an air/fuel mixture, said sensor generating an output signal correlated with an air/fuel composition of said mixture, said method comprising the steps of:

a) determining a present operating temperature of said engine; and b) effecting a hot diagnosis of said sensor when the present operating temperature of the engine is greater than a preset reference value, said hot diagnosis comprising the steps of:

1) determining whether said engine is presently in an idle operating condition and said sensor is presently generating an output signal that indicates a lean air/fuel composition of said mixture, and if so:

i) enrichening said mixture, to create a transition of the composition of said mixture from a lean to a rich air/fuel composition; and ii) determining a first value assumed by the output signal from said sensor in response to said enrichening, said first value being correlated to a rich air/fuel composition of said mixture;

2) determining whether said engine is presently in a fuel cut-off condition of a duration greater than a preset threshold, and whether said air/fuel mixture had a rich composition prior to the occurrence of said cut-off condition, and if so:

i) determining a second value assumed by the output signal from said sensor in response to said cut-off condition, said second value being correlated to a lean air/fuel composition of said mixture;

3) comparing said first value with a first threshold value;

4) comparing said second value with a second threshold value; and 5) generating a deterioration signal for said sensor if either said first value is below said first threshold value, or said second value is above said second threshold value.

2. The method of claim 1, wherein said hot diagnosis further comprises the steps of:

6) determining an intermediate value lying between said first and second values;

7) comparing said intermediate value with a third preset threshold value and with a fourth preset threshold value; and 8) generating a deterioration signal for said sensor if said intermediate value is either less than said third threshold value or greater than said fourth threshold value.

3. The method of claim 2, wherein said intermediate value lying between said first and second values is determined using the following formula:

$$V_{int}=(V_{max}-V_{min})/2$$

in which $V_{int}$ is equal to said intermediate value, $V_{min}$ is equal to the said second value and $V_{max}$ is equal to said first value.

4. The method of claim 1, wherein said hot diagnosis further comprises the steps of acquiring a third value correlated with a first switching time for said output signal from said sensor, and a fourth value correlated with a second switching time for said output signal.

5. The method of claim 4, wherein the steps of acquiring a third value and a fourth value further comprise the steps of:

i) enrichening said mixture, to create a transition of said mixture from a lean to a rich air/fuel composition, and an enrichment transition of said output signal from said sensor;

ii) determining a first switching delay between said transition of said mixture from a lean to a rich air/fuel composition and said enrichment transition of said output signal;

iii) determining said third value from said first switching delay;

iv) prompting a transition of said mixture from a rich to a lean air/fuel composition, and a leaning transition of said output signal from said sensor;

v) determining a second switching delay between said transition of said mixture from a rich to a lean air/fuel composition and said leaning transition of said output signal; and vi) determining said fourth value from said second switching delay.

6. The method of claim 5, wherein said hot diagnosis further comprises the steps of determining whether one of said first and second switching delays has undergone excessive variations relative to the other of said first and second switching delays, and if so, generating a deterioration signal for said sensor.

7. The method of claim 6, wherein said steps of determining whether one of said first and second switching delays has undergone excessive variations relative to the other of said first and second switching delays, and if so, generating a deterioration signal for said sensor, further comprise:

i) generating a first moving average value correlated with said third value;

ii) generating a second moving average value correlated with said fourth value;

iii) comparing said first moving average value with a fifth preset threshold value;

iv) comparing said second moving average value with a sixth preset threshold value; and v) generating a deterioration signal for said sensor if said comparisons give different outcomes.

8. The method of claim 5, wherein said third value correlated with said first switching time for said output signal from said sensor is calculated using the following formula:

$$I_2 = \int_{t_0}^{t_s} (V - V_{ref})\,dt$$

wherein $I_2$ is said third value, V is said output signal from said sensor, $V_{ref}$ is a preset reference value, $t_0$ is the instant in time at which said transition of said mixture from a lean to a rich composition occurs, and $t_s$ is the instant in time at which said enrichening transition of said output signal occurs; and said fourth value correlated with said second switching time for said output signal from said sensor is calculated using the following formula:

$$I_1 = \int_{t_0}^{t_s} (V_{ref} - V)\,dt$$

wherein $I_1$ is said fourth value, V is said output signal from said sensor, $V_{ref}$ is a preset reference value, $t_0$ is the instant in time at which said transition of said mixture from a rich to a lean air/fuel composition occurs, and $t_s$ is the instant in time at which said leaning transition of said output signal occurs.

9. The method of claim 1, further comprising the steps of:

c) effecting a cold diagnosis when the temperature of said engine is below said preset reference value, said engine is in a steady operating condition and a mixture composition control signal generated by said sensor is steady; said cold diagnosis comprising the steps of:

1) enrichening said mixture, to create a transition of the mixture from a lean to a rich air/fuel composition;

2) determining a third value assumed by the output signal from said sensor in response to said enrichening;

3) leaning said mixture, to create a transition of the mixture from a rich to a lean air/fuel composition;

4) determining a fourth value assumed by the output signal from said sensor in response to said leaning;

5) comparing said third value with a third threshold value;

6) comparing said fourth value with a fourth threshold value; and 7) generating a deterioration signal for said sensor if either said third value is below said third threshold value, or said fourth value is above said fourth threshold value.

10. A method of diagnosing the efficiency of an exhaust gas stoichiometric composition sensor placed downstream of a catalytic converter mounted on an exhaust manifold of an internal combustion engine supplied with an air/fuel mixture, said sensor generating an output signal correlated with an air/fuel composition of said mixture, said method comprising the steps of:

a) enrichening said mixture, to create a transition of the mixture from a lean to a rich air/fuel composition;

b) determining a first value assumed by the output signal from said sensor in response to said enrichening;

c) leaning said mixture, to create a transition of the mixture from a rich to a lean air/fuel composition;

d) determining a second value assumed by the output signal from said sensor in response to said leaning;

e) determining an intermediate value lying between said first and second values;

f) comparing said first value with a first threshold value;

g) comparing said second value with a second threshold value;

h) comparing said intermediate value with a third preset threshold value;

i) comparing said intermediate value with a fourth preset threshold value; and j) generating a deterioration signal for said sensor if any of the following is true:

1) said first value is below said first threshold value;

2) said second value is above said second threshold value;

3) said intermediate value is less than said third threshold value; or 4) said intermediate value is greater than said fourth threshold value.

11. The method of claim 10, wherein said intermediate value lying between said first and second values is determined using the following formula:

$$V_{int}=(V_{max}-V_{min})/2$$

in which $V_{int}$ is equal to said intermediate value, $V_{min}$ is equal to the said second value and $V_{max}$ is equal to said first value.

12. A method of diagnosing the efficiency of an exhaust gas stoichiometric composition sensor placed downstream of a catalytic converter mounted on an exhaust manifold of an internal combustion engine supplied with an air/fuel mixture, said sensor generating an output signal correlated with an air/fuel composition of said mixture, said method comprising the steps of:

a) enrichening said mixture, to create a transition of the mixture from a lean to a rich air/fuel composition and an enrichening transition of said output signal from said sensor;

b) acquiring a first value correlated with a first switching time for said output signal from said sensor by determining a first switching delay between said transition of said mixture from a lean to a rich air/fuel composition and said enrichening transition of said output signal, and determining said first value from said first switching delay;

c) prompting a transition of said mixture from a rich to a lean air/fuel composition and a leaning transition of said output signal from said sensor;

d) acquiring a second value correlated with a second switching time for said output signal from said sensor by determining a second switching delay between said transition of said mixture from a rich to a lean air/fuel composition and said leaning transition of said output signal, and determining said second value from said second switching delay;

e) generating a first moving average value correlated with said first value;

f) generating a second moving average value correlated with said second value;

g) comparing said first moving average value with a first preset threshold value;

h) comparing said second moving average value with a second preset threshold value; and i) generating a deterioration signal for said sensor if said comparisons give different outcomes.

13. The method of claim 12, wherein said first value correlated with said first switching time for said output signal from said sensor is calculated using the following formula:

$$I_2 = \int_{t_0}^{t_s} (V - V_{ref})\,dt$$

wherein $I_2$ is said first value, V is said output signal from said sensor, $V_{ref}$ is a preset reference value, $t_0$ is the instant in time at which said transition of said mixture from a lean to a rich air/fuel composition occurs, and $t_s$ is the instant in time at which said enrichening transition of said output signal occurs; and said second value correlated with said second switching time for said output signal from said sensor is calculated using the following formula:

$$I_1 = \int_{t_0}^{t_s} (V_{ref} - V)\,dt$$

wherein $I_1$ is said second value, V is said output signal from said sensor, $V_{ref}$ is a preset reference value, $t_0$ is the instant in time at which said transition of said mixture from a rich to a lean air/fuel composition occurs, and $t_s$ is the instant in time at which said leaning transition of said output signal occurs.

14. Apparatus for diagnosing the efficiency of an exhaust gas stoichiometric composition sensor placed downstream of a catalytic converter mounted on an exhaust manifold of an internal combustion engine supplied with an air/fuel mixture, said sensor generating an output signal correlated with an air/fuel composition of said mixture, said apparatus comprising:

a) means for determining a present operating temperature of said engine;

b) means for determining a present operating condition of said engine; and c) means for effecting a hot diagnosis of said sensor when the present operating temperature of the engine is greater than a preset reference value, said means for effecting a hot diagnosis comprising means for:

1) determining whether said engine is presently in an idle operating condition and said sensor is presently generating an output signal that indicates a lean air/fuel composition of said mixture, and if so:

i) enrichening said mixture, to create a transition of the air/fuel composition of said mixture from a lean to a rich air/fuel composition; and ii) determining a first value assumed by the output signal from said sensor in response to said enrichening, said first value being correlated to a rich air/fuel composition of said mixture;

2) determining whether said engine is presently in a fuel cut-off condition of a duration greater than a preset threshold, and whether said air/fuel mixture had a rich composition prior to the occurrence of said cut-off condition, and if so:

i) determining a second value assumed by the output signal from said sensor in response to said cut-off condition, said second value being correlated to a lean air/fuel composition of said mixture;

3) comparing said first value with a first threshold value;

4) comparing said second value with a second threshold value; and 5) generating a deterioration signal for said sensor if either said first value is below said first threshold value, or said second value is above said second threshold value.

15. The apparatus of claim 14, wherein said means for effecting a hot diagnosis further comprises means for:

6) determining an intermediate value lying between said first and second values; and 7) comparing said intermediate value with a third preset threshold value and with a fourth preset threshold value; and 8) generating a deterioration signal for said sensor if said intermediate value is either less than said third threshold value or is greater than said fourth threshold value.

16. The apparatus of claim 15, wherein said intermediate value lying between said first and second values is determined by said means for effecting a hot diagnosis using the following formula:

$$V_{int}=(V_{max}=V_{min})/2$$

in which $V_{int}$ is equal to said intermediate value, $V_{min}$ is equal to said second value and $V_{max}$ is equal to said first value.

17. The apparatus of claim 14, wherein said means for effecting a hot diagnosis further comprises means for acquiring a third value correlated with a first switching time for said output signal from said sensor, and a fourth value correlated with a second switching time for said output signal.

18. The apparatus of claim 17, wherein said means for acquiring a third value and a fourth value further comprise means for:

i) enrichening said mixture, to create a transition of said mixture from a lean to a rich air/fuel composition, and an enrichment transition of said output signal from said sensor;

ii) determining a first switching delay between said transition of said mixture from a lean to a rich air/fuel composition and said enrichment transition of said output signal;

iii) determining said third value from said first switching delay;

iv) prompting a transition of said mixture from a rich to a lean air/fuel composition, and a leaning transition of said output signal from said sensor;

v) determining a second switching delay between said transition of said mixture from a rich to a lean air/fuel composition and said leaning transition of said output signal; and vi) determining said fourth value from said second switching delay.

19. The apparatus of claim 18, wherein said means for effecting a hot diagnosis further comprises means for determining whether one of said first and second switching delays has undergone excessive variations relative to the other of said first and second switching delays, and if so, generating a deterioration signal for said sensor.

20. The apparatus of claim 19, wherein said means for determining whether one of said first and second switching delays has undergone excessive variations relative to the other of said first and second switching delays, and if so, generating a deterioration signal for said sensor, further comprises means for:

i) generating a first moving average value correlated with said third value;

ii) generating a second moving average value correlated with said fourth value;

iii) comparing said first moving average value with a fifth preset threshold value;

iv) comparing said second moving average value with a sixth preset threshold value; and v) generating a deterioration signal for said sensor if said comparisons give different outcomes.

21. The apparatus of claim 18, wherein said third value correlated with said first switching time for said output signal from said sensor is calculated using the following formula:

$$I_2 = \int_{t_0}^{t_s} (V - V_{ref})\,dt$$

wherein $I_2$ is said third value, V is said output signal from said sensor, $V_{ref}$ is a preset reference value, $t_0$ is the instant in time at which said transition of said mixture from a lean to a rich air/fuel composition occurs, and $t_s$ is the instant in time at which said enrichening transition of said output signal occurs; and said fourth value correlated with said second switching time for said output signal from said sensor is calculated using the following formula:

$$I_1 = \int_{t_0}^{t_s} (V_{ref} - V)\,dt$$

wherein $I_1$ is said fourth value, V is said output signal from said sensor, $V_{ref}$ is a preset reference value, $t_0$ is the instant in time at which said transition of said mixture from a rich to a lean air/fuel composition occurs, and $t_s$ is the instant in time at which said leaning transition of said output signal occurs.

22. The apparatus of claim 14, further comprising:

d) means for effecting a cold diagnosis when the temperature of said engine is below said preset reference value, said engine is in a steady operating condition and a mixture air/fuel composition control signal generated by said sensor is steady, said means for effecting a cold diagnosis further comprising means for:

1) enrichening said mixture, to create a transition of the mixture from a lean to a rich air/fuel composition;

2) determining a third value assumed by the output signal from said sensor in response to said enrichening;

3) leaning said mixture, to create a transition of the mixture from a rich to a lean air/fuel composition;

4) determining a fourth value assumed by the output signal from said sensor in response to said leaning;

5) comparing said third value with a third threshold value;

6) comparing said fourth value with a fourth threshold value; and 7) generating a deterioration signal for said sensor if either said third value is below said third threshold value, or said fourth value is above said fourth threshold value.

23. Apparatus for diagnosing the efficiency of an exhaust gas stoichiometric composition sensor placed downstream of a catalytic converter mounted on an exhaust manifold of an internal combustion engine supplied with an air/fuel mixture, said sensor generating an output signal correlated with an air/fuel composition of said mixture, said apparatus comprising:

a) means for determining a present operating condition of said engine; and b) means responsive to a determined condition of said engine for effecting a diagnosis of said sensor comprising means for:

1) enrichening said mixture, to create a transition of the mixture from a lean to a rich air/fuel composition;

2) determining a first value assumed by the output signal from said sensor in response to said enrichening;

3) leaning said mixture, to create a transition of the mixture from a rich to a lean air/fuel composition;

4) determining a second value assumed by the output signal from said sensor in response to said leaning;

5) determining an intermediate value lying between said first and second values;

6) comparing said first value with a first threshold value;

7) comparing said second value with a second threshold value;

8) comparing said intermediate value with a third preset threshold value;

9) comparing said intermediate value with a fourth preset threshold value; and 10) generating a deterioration signal for said sensor if any of the following is true:

i) said first value is below said first threshold value;

ii) said second value is above said second threshold value;

iii) said intermediate value is less than said third threshold value; or iv) said intermediate value is greater than said fourth threshold value.

24. The apparatus of claim 23, wherein said intermediate value lying between said first and second values is determined using the following formula:

$$V_{int}=(V_{max}-V_{min})/2$$

in which $V_{int}$ is equal to said intermediate value, $V_{min}$ is equal to the said second value and $V_{max}$ is equal to said first value.

25. Apparatus for diagnosing the efficiency of an exhaust gas stoichiometric composition sensor placed downstream of a catalytic converter mounted on an exhaust manifold of an internal combustion engine supplied with an air/fuel mixture, said sensor generating an output signal correlated with an air/fuel composition of said mixture, said apparatus comprising:

a) means for determining a present operating condition of said engine; and b) means responsive to a determined condition of said engine for effecting a diagnosis of said sensor comprising means for:

1) enrichening said mixture, to create a transition of the mixture from a lean to a rich air/fuel composition and an enrichening transition of said output signal from said sensor;

2) acquiring a first value correlated with a first switching time for said output signal from said sensor by determining a first switching delay between said transition of said mixture from a lean to a rich air/fuel composition and said enrichening transition of said output signal, and determining said first value from said first switching delay;

3) prompting a transition of said mixture from a rich to a lean air/fuel composition and a leaning transition of said output signal from said sensor;

4) acquiring a second value correlated with a second switching time for said output signal from said sensor by determining a second switching delay between said transition of said mixture from a rich to a lean air/fuel composition and said leaning transition of said output signal, and determining said second value from said second switching delay;

5) generating a first moving average value correlated with said first value;

6) generating a second moving average value correlated with said second value;

7) comparing said first moving average value with a first preset threshold value;

8) comparing said second moving average value with a second preset threshold value; and 9) generating a deterioration signal for said sensor if said comparisons give different outcomes.

26. The apparatus of claim 25, wherein said first value correlated with said first switching time for said output signal from said sensor is determined using the following formula:

$$I_2 = \int_{t_0}^{t_s} (V - V_{ref})\,dt$$

wherein $I_2$ is said first value, V is said output signal from said sensor, $V_{ref}$ is a preset reference value, $t_0$ is the instant in time at which said transition of said mixture from a lean to a rich air/fuel composition occurs, and $t_0$ is the instant in time at which said enrichening transition of said output signal occurs; and said second value correlated with said second switching time for said output signal from said sensor is calculated using the following formula:

$$I_1 = \int_{t_0}^{t_s} (V_{ref} - V)\,dt$$

wherein $I_1$ is said second value, V is said output signal from said sensor, $V_{ref}$ is a preset reference value, $t_0$ is the instant in time at which said transition of said mixture from a rich to a lean air/fuel composition occurs, and $t_s$ is the instant in time at which said leaning transition of said output signal occurs.

* * * * *